US008911562B2

(12) United States Patent
Gonzalez

(10) Patent No.: US 8,911,562 B2
(45) **Date of Patent: *Dec. 16, 2014**

(54) CLEANING COMPOSITIONS FOR REMOVING ORGANIC DEPOSITS ON SURFACES AND METHOD OF USE

(76) Inventor: Marco T. Gonzalez, Pembroke Pines, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/041,994

(22) Filed: Mar. 7, 2011

(65) Prior Publication Data

US 2011/0155178 A1 Jun. 30, 2011

Related U.S. Application Data

(63) Continuation-in-part of application No. 12/264,938, filed on Nov. 5, 2008, now Pat. No. 7,901,516.

(60) Provisional application No. 60/985,302, filed on Nov. 5, 2007.

(51) Int. Cl.

| | |
|---|---|
| ***B08B 3/10*** | (2006.01) |
| ***B08B 3/08*** | (2006.01) |
| ***C11D 7/26*** | (2006.01) |
| ***C11D 7/50*** | (2006.01) |
| ***C11D 1/66*** | (2006.01) |
| ***C11D 11/00*** | (2006.01) |
| ***C11D 1/72*** | (2006.01) |
| ***C11D 3/20*** | (2006.01) |
| ***A24F 9/12*** | (2006.01) |

(52) U.S. Cl.

CPC .. *C11D 1/72* (2013.01); *C11D 1/66* (2013.01); *C11D 11/0023* (2013.01); *C11D 3/2072* (2013.01); *A24F 9/12* (2013.01)

USPC ..... 134/34; 134/26; 134/40; 510/109; 510/505

(58) Field of Classification Search

USPC ..... 134/22.1, 22.12, 22.14, 22.16, 22.18, 134/22.19, 40; 510/109

See application file for complete search history.

(56) References Cited

U.S. PATENT DOCUMENTS

| | | | | |
|---|---|---|---|---|
| 5,922,665 | A * | 7/1999 | Liu | 510/365 |
| 6,281,189 | B1 * | 8/2001 | Heimann et al. | 510/491 |
| 6,284,056 | B1 * | 9/2001 | Gonzalez | 134/40 |
| 2002/0174500 | A1 * | 11/2002 | Micciche et al. | 15/104.93 |
| 2005/0032665 | A1 * | 2/2005 | Goode et al. | 510/407 |

FOREIGN PATENT DOCUMENTS

JP 54087711 A * 7/1979

OTHER PUBLICATIONS

Derwent Abstract: JP 54-087711A, Hisamoto et al., 1979.*

* cited by examiner

*Primary Examiner* — Michael Kornakov
*Assistant Examiner* — Natasha Campbell
(74) *Attorney, Agent, or Firm* — David W. Barman

(57) ABSTRACT

The present invention is improved cleaning method using a composition having at least one ketone for cleaning organic residue.

6 Claims, No Drawings

CLEANING COMPOSITIONS FOR REMOVING ORGANIC DEPOSITS ON SURFACES AND METHOD OF USE

INDEX TO RELATED APPLICATIONS

This application is a continuation-in-part of U.S. patent application Ser. No. 12/264,938 filed Nov. 5, 2008, which claims benefit of U.S. Provisional Patent Application No. 60/985,302 filed Nov. 5, 2007, the disclosures of which is incorporated herein by reference in their entirety.

BACKGROUND OF THE INVENTION

Prior inventions in their most basic forms consist of an alcohol, water, salt in crystalline form, and a surfactant. The previous inventions are used to remove organic deposits from hard to reach surfaces, specifically in smoker's devices. The previous inventions require the consumer to shake the item being cleaned vigorously, for approximately one minute while submerged in the cleaning composition. Salt, in crystalline form, acts as an abrasive material working side-by-side with the liquid portion of the cleaning composition to remove organic deposit in the hard to reach places. The first problem with the previous inventions is the amount of time required to remove the organic deposits can be quite tiresome. The second problem with the previous inventions is they do not completely remove all organic residues on internal hard to reach surfaces, as well as external reachable surfaces. Finally, the previous inventions contain an excessive amount of abrasive material, which limits the amount liquid cleaning solution of the composition available to the consumer. By adding a ketone, in the form of acetone, to the previous inventions the cleaning time is reduced by 100%, all organic residue's are removed, and the abrasive materials are reduced by half, if not eliminated.

BRIEF SUMMARY OF THE INVENTION

The current invention provides an improved cleaning composition, which cleans and sterilizes more effectively and efficiently in a period of 1-30 seconds. This was accomplished by a formulation based on acetone, a ketone. Additionally, according to the Environmental Protection Agency acetone is no longer referred to as volatile organic compound, and has been labeled as relatively non-toxic and readily biodegradable in water.

Acetone based cleaning products result in all residues being removed on both internal and external surfaces. Additionally, acetone based cleaning products allow the liquid portion of the composition to work more effectively allowing the abrasive material to act as more of an aide to the liquid portion rather than working side-by-side the liquid portion of the composition. Acetone based cleaning products allow for reduction of the abrasive material by at least half, and/or eliminate abrasive material all together.

DETAILED DESCRIPTION OF THE PREFERRED EMBODIMENTS

The present invention in its most basic form includes:

1) a ketone, preferably acetone form of acetone
2) an inorganic salt
3) water wherein from approximately 1% to approximately 80% of the total composition is acetone, and approximately 0.0001% to approximately 29% of the total composition is an inorganic salt.

The following is a list of acceptable salts for the first preferred embodiment:

| | | | |
|---|---|---|---|
| Sodium Chloride | NaCl | mwt. 58.4428 | sp. gr. 2.165 |
| Sodium Bromide | NaBr | mwt. 102.90 | sp. gr. 3.203 |
| Magnesium Bromide | MgBr | mwt. 184.13 | sp. gr. 3.72 |
| Magnesium Chloride | MgCl | mwt. 95.22 | sp. gr. 2.316 |
| Potassium Chloride | KCL | mwt. 74.54 | sp. gr. 1.984 |
| Potassium Bromide | KBr | mwt. 119.01 | sp. gr. 2.75 |
| Zinc Chloride | ZnCl | mwt. 136.30 | sp. gr. 2.91 |

A preferred salt is Sodium Chloride.

A preferred embodiment of the present invention includes:

1) a ketone in the form of acetone
2) an inorganic salt
3) water
4) a surfactant wherein from approximately 1% to approximately 80% of the total composition is acetone, and approximately 0.0001% to approximately 29% of the total composition is an inorganic salt, and approximately 0.05% to 10% of the total composition consists of octoxynol, a surfactant.

A second embodiment of the present invention includes:

1) a ketone in the form of acetone
2) an inorganic salt
3) water
4) a terpene
5) and a surfactant wherein from approximately 1% to approximately 80% of the total composition is acetone, approximately 0.0001% to approximately 29% of the total composition is an inorganic salt, approximately 2% to approximately 15% of the total composition consists of d-limonene, a terpene, and approximately 0.05% to approximately 10% of the total composition consists of octoxynol, a surfactant.

The third preferred embodiment of the present invention includes:

1) a ketone in the form of acetone
2) water
3) a terpene
4) a surfactant wherein from approximately 1% to approximately 80% of the total composition is acetone, approximately 2% to approximately 15% of the total composition includes of d-limonene, a terpene, and approximately 0.05% to approximately 10% of the total composition includes octoxynol, a surfactant.

Example #1

This example contains following components:

| Component | wt. % |
|---|---|
| Acetone | 55 |
| Sodium Chloride (crystal) | 24 |
| Deionized water | 16 |
| Octoxynol-9 | 2 |
| Fragrance | 1.5 |
| Dye | 1.5 |
| Total | 100% |

This was prepared by first water with octoxynol, fragrance, and dye. Then, acetone was added and it was mixed completely. Next, the sodium chloride crystals were added to the mixture slowly to allow small portions to dissolve. Finally, the composition was shaken thoroughly. Once settled, the composition remained stable.

The composition was then shaken again and poured into a substrate containing a large amount of organic deposits. It was then shaken vigorously for approximately 30 seconds. Results were noticeable immediately. All organic deposits from the interior were successfully removed without damage to the substrate.

The composition was again tested on a much smaller substrate. Due to size, the substrate was placed into a resealable plastic bag. This substrate also contained organic deposits on the exterior, as well as the interior. The substrate was then shaken for 30 seconds. Results were noticeable immediately. All organic deposits from the interior, as well as the exterior, were successfully removed without damage to the substrate.

Example #2

This example contains following components:

| Component | % wt. |
|---|---|
| Acetone | 59 |
| Sodium Chloride (crystal) | 20 |
| Deionized Water | 6.5 |
| D-limonene | 8 |
| Octoxynol-9 | 3 |
| Fragrance | 1.5 |
| Dye | 2.0 |
| Total | 100% |

This was prepared by first combining water with the octoxynol, d-limonene, fragrance, and dye. Then, acetone was added and the solution was mixed completely. Next, finely divided sodium chloride crystals were added to the mixture slowly, which allowed small portions to dissolve. Finally, the composition was shaken thoroughly. Once settled, the composition remained stable.

The composition was then shaken again and poured into a substrate containing a large amount of organic deposits. It was then shaken vigorously for approximately 30 seconds. Results were noticeable immediately. All organic deposits from the interior were successfully removed without damage to the substrate.

The composition was again tested on a much smaller substrate. Due to size, the substrate was placed into a resealable plastic bag. This substrate also contained organic deposits on the exterior, as well as the interior. The substrate was then shaken for 30 seconds. Results were noticeable immediately. All organic deposits from the interior, as well as the exterior, were successfully removed without damage to the substrate.

Example #3

| Component | % wt. |
|---|---|
| Acetone | 74 |
| Deionized water | 9 |
| D-limonene | 10 |
| Octoxynol-9 | 4 |
| Fragrance | 1.5 |
| Dye | 1.5 |
| Total | 100% |

This was prepared by first combining water with the octoxynol, d-limonene, fragrance, and dye. Then, acetone was added and the solution was mixed completely. Once settled, the composition remained stable.

The composition was then shaken again and poured into a substrate containing a large amount of organic deposits. It was then shaken vigorously for approximately 30 seconds. Results were noticeable immediately. All organic deposits from the interior were successfully removed without damage to the substrate.

The composition was again tested on a much smaller substrate. Due to size, the substrate was placed into a resealable plastic bag. This substrate also contained organic deposits on the exterior, as well as the interior. The substrate was then shaken for 30 seconds. Results were noticeable immediately. All organic deposits from the interior, as well as the exterior, were successfully removed without damage to the substrate.

As one can see from the examples above, all organic deposits were successfully removed from all test substrates. Therefore, by adding acetone to the previous inventions the main objectives to reduce cleaning time by 100%, remove all organic residues, and to reduce abrasive materials by half, if not eliminate, were completed.

And an additional formulation includes:

a) Acetone b) Water c) An inorganic salt, preferably NaCl d) A nonionic surfactant, preferably octoxynol-5, octoxynol-8, and/or octoxynol-13

A second additional formulation includes:

a) Acetone b) Water c) An inorganic salt, preferably NaCl d) A nonionic surfactant, preferably octoxynol-5, octoxynol-8, and/or octoxynol-13 e) A terpene, preferably D-Limonene

A third additional formulation (without NaCl) includes:

a) Acetone b) Water c) A nonionic surfactant, preferably octoxynol-5, octoxynol-8, and/or octoxynol-13

A fourth additional formulation (without NaCl) includes:

a) Acetone b) Water c) A nonionic surfactant, preferably octoxynol-5, octoxynol-8, and/or octoxynol-13 d) A terpene, preferably D-Limonene

Ketone Example #1

| | |
|---|---|
| Acetone | 67% |
| Water | 13.3% |
| NaCl | 19.7% |

This was prepared by first combining acetone and water. Next, the sodium chloride crystals were added to the mixture slowly to allow small portions to dissolve. Finally, the composition was shaken thoroughly. Once settled, the composition remained stable.

Ketone Example #2

| | |
|---|---|
| Acetone | 65% |
| Water | 13.3% |
| NaCl | 19.7 |
| Octoxynol-13 | 2% |

This was prepared by first combining acetone, water, and octoxynol-13. Next, the sodium chloride crystals were added to the mixture slowly to allow small portions to dissolve. Finally, the composition was shaken thoroughly. Once settled, the composition remained stable.

Ketone Example #3

| | |
|---|---|
| Acetone | 65% |
| Water | 13.3% |
| NaCl | 19.7% |
| Octoxynol-5 | 2% |

This was prepared by first combining acetone, water, and octoxynol-5. Next, the sodium chloride crystals were added to the mixture slowly to allow small portions to dissolve. Finally, the composition was shaken thoroughly. Once settled, the composition remained stable.

Ketone Example #4

| | |
|---|---|
| Acetone | 65% |
| Water | 13.3% |
| NaCl | 19.7% |
| Octoxynol-8 | 2% |

This was prepared by first combining acetone, water, and octoxynol-8. Next, the sodium chloride crystals were added to the mixture slowly to allow small portions to dissolve. Finally, the composition was shaken thoroughly. Once settled, the composition remained stable.

Ketone Example #5

| | |
|---|---|
| Acetone | 59% |
| Water | 13.3% |
| NaCl | 19.7% |
| Octoxynol-5 | 2% |
| D-Limonene | 6% |

This was prepared by first combining acetone, water, octoxynol-8, and d-limonene. Next, the sodium chloride crystals were added to the mixture slowly to allow small portions to dissolve. Finally, the composition was shaken thoroughly. Once settled, the composition remained stable.

Ketone Example #6

| | |
|---|---|
| Acetone | 65% |
| Water | 13.3% |
| Octoxynol-8 | 5% |
| D-Limonene | 16.7 |

This was prepared by first combining acetone, water, octoxynol-8, and d-limonene. No NaCl was added to this composition. Then the composition was shaken thoroughly. Once settled, the composition remained stable.

Ketone Example #7

| | |
|---|---|
| Acetone | 62% |
| Water | 13.3% |
| NaCl | 19.7% |
| Nonionic Surfactant | 2% |
| Fragrance | 1.4% |
| Dye | 1.6% |

This was prepared by first combining acetone, water, and octoxynol-8. Next, the sodium chloride crystals were added to the mixture slowly to allow small portions to dissolve. Finally, the composition was shaken thoroughly. Once settled, the composition remained stable.

It has been discovered that certain embodiments are functional in the present invention by utilizing an ionic surfactant.

Ionic Surfactant Examples

Example #1

| Component | wt. % |
|---|---|
| Acetone | 99 |
| Water | 0.5 |
| Ionic Surfactant | 0.5 |
| Total | 100% |

Example 1 was prepared by first combining water with an ionic surfactant. Then, acetone was added and it was mixed completely. The composition remained stable. The composition was then shaken prior to use and poured vessel containing a large amount of organic deposits disposed on the interior surface. The vessel with the composition was then shaken vigorously until clean. Results were noticeable immediately. All visual organic deposits from the interior were successfully removed without damage to the substrate.

In one embodiment, Example #1 is prepared as:

| Component | wt. % |
|---|---|
| Acetone | 99 |
| Water | 0.5 |
| Alkanol XC | 0.5 |
| Total | 100% |

Example #2

| Component | wt. % |
|---|---|
| Acetone | 50 |
| Water | 49 |
| Ionic Surfactant | 1 |
| Total | 100% |

Example 2 was prepared by first combining water with an ionic surfactant. Then, acetone was added and it was mixed completely. The composition remained stable. The composition was then shaken prior to use and poured vessel containing a large amount of organic deposits disposed on the interior surface. The vessel with the composition was then shaken vigorously until clean. Results were noticeable immediately. All visual organic deposits from the interior were successfully removed without damage to the substrate.

Example #3

| Component | wt. % |
|---|---|
| Acetone | 50 |
| Water | 1 |
| Ionic Surfactant | 49 |
| Total | 100% |

Example 3 was prepared by first combining water with an ionic surfactant. Then, acetone was added and it was mixed completely. The composition remained stable. The composition was then shaken prior to use and poured vessel containing a large amount of organic deposits disposed on the interior surface. The vessel with the composition was then shaken vigorously until clean. Results were noticeable immediately. All visual organic deposits from the interior were successfully removed without damage to the substrate.

Example #4

This example contains following components:

| Component | wt. % |
|---|---|
| Acetone | 50 |
| Water | 26 |
| Ionic Surfactant | 24 |
| Total | 100% |

Example 4 was prepared by first combining water with an ionic surfactant. Then, acetone was added and it was mixed completely. The composition remained stable. The composition was then shaken prior to use and poured vessel containing a large amount of organic deposits disposed on the interior surface. The vessel with the composition was then shaken vigorously until clean. Results were noticeable immediately. All visual organic deposits from the interior were successfully removed without damage to the substrate. In the cleaning example using Example 4, the vessel was shaken vigorously for up to 300 seconds, or 5 minutes, or until clean. Results were noticeable immediately.

The desired ratio of ketone to ionic surfactant in examples 1, 2, 3, and 4 does not exceed a 1:1 ratio.

Preferred ionic surfactants include, but are not limited to: Alkanol 189-S surfactant, Alkanol XC surfactant, Dioctyl sulfosuccinate sodium salt 96%, Glycolic acid ethoxylate 4-nonylphenyl ether, Glycolic acid ethoxylate 4-tert-butylphenyl, Glycolic acid ethoxylate lauryl ether, Glycolic acid ethoxylate oleyl ether, N,N-Dimethyl-N-[3-(sulfooxy)propyl]-1-nonanaminium hydroxide inner salt, Poly(ethylene glycol) 4-nonylphenyl 3-sulfopropyl ether potassium salt, Sodium dodecylbenzenesulfonate, Synperonic L 122, Synperonic NP 30, Synperonic PE P105, Zonyl® 7950, Zonyl FSA fluorosurfactant, Zonyl FSE fluorosurfactant, Zonyl FSP fluorosurfactant.

A preferred ionic surfactant is Alkanol, specifically Alkanol XC.

Non-Ionic Surfactant

The following examples contain a nonionic surfactant and require 31 seconds of cleaning or more.

Example #5

| Component | wt. % |
|---|---|
| Acetone | 99 |
| Water | 0.5 |
| Nonionic Surfactant | 0.5 |
| Total | 100% |

The composition of Example 5 was prepared by first combining water with nonionic Surfactant. Then, acetone was added and it was mixed completely. The composition remained stable. The composition was then shaken again and poured into a vessel containing a large amount of organic deposits disposed on the interior surface. The vessel containing the composition was then shaken vigorously for 31 seconds to 300 seconds, or 5 minutes, or until clean. Results were noticeable immediately. All visual organic deposits from the interior were successfully removed without damage to the vessel.

One preferred embodiment of Example 5 has the following composition:

| Component | wt. % |
|---|---|
| Acetone | 99 |
| Water | 0.5 |
| Octoxynol | 0.5 |
| Total | 100% |

Example #6

| Component | wt. % |
|---|---|
| Acetone | 50 |
| Water | 1 |
| Nonionic Surfactant | 49 |
| Total | 100% |

The composition of Example 6 was prepared by first combining water with nonionic Surfactant. Then, acetone was added and it was mixed completely. The composition remained stable. The composition was then shaken again and poured into a vessel containing a large amount of organic deposits disposed on the interior surface. The vessel containing the composition was then shaken vigorously for 31 seconds to 300 seconds, or 5 minutes, or until clean. Results were noticeable immediately. All visual organic deposits from the interior were successfully removed without damage to the vessel.

Example #7

| Component | wt. % |
|---|---|
| Acetone | 50 |
| Water | 26 |
| NonIonic Surfactant | 24 |
| Total | 100% |

The composition of Example 6 was prepared by first combining water with nonionic Surfactant. Then, acetone was added and it was mixed completely. The composition remained stable. The composition was then shaken again and poured into a vessel containing a large amount of organic deposits disposed on the interior surface. The vessel containing the composition was then shaken vigorously for 31 seconds to 300 seconds, or 5 minutes, or until clean. Results were noticeable immediately. All visual organic deposits from the interior were successfully removed without damage to the vessel.

The desired ratio of ketone to nonionic surfactant in examples 5, 6, and 7 does not exceed a 1:1 ratio.

The following examples require up to 30 seconds of cleaning.

Example #8

| Component | wt. % |
|---|---|
| Acetone | 99 |
| Water | 0.5 |
| NonIonic Surfactant | 0.5 |
| Total | 100% |

Example 8 prepared by first combining water with nonionic surfactant. Then, acetone was added and it was mixed completely. The composition remained stable. The composition was then shaken again and poured into a vessel containing a large amount of organic deposits disposed on the interior surface. It was then shaken vigorously up to 30 seconds. Results were noticeable immediately. All organic deposits from the interior were successfully removed without damage to the vessel.

Example #9

This example contains following components:

| Component | wt. % |
|---|---|
| Acetone | 81 |
| Water | 18.95 |
| Nonionic Surfactant | 0.05 |
| Total | 100% |

Example 9 was prepared by first combining water with nonionic surfactant. Then, acetone was added and it was mixed completely. The composition remained stable. The composition was then shaken again and poured into a vessel containing a large amount of organic deposits disposed on the interior surface. It was then shaken vigorously up to 30 seconds. Results were noticeable immediately. All organic deposits from the interior were successfully removed without damage to the vessel.

Example #10

| Component | wt. % |
|---|---|
| Acetone | 81 |
| Water | 0.05 |
| Nonionic Surfactant | 18.95 |
| Total | 100% |

Example 10 was prepared by combining water with nonionic surfactant. Then, acetone was added and it was mixed completely. The composition remained stable. The composition was then shaken again and poured into a vessel containing a large amount of organic deposits disposed on the interior surface. It was then shaken vigorously up to 30 seconds. Results were noticeable immediately. All organic deposits from the interior were successfully removed without damage to the substrate.

Preferred nonionic surfactants include, but are not limited to:

Arkopal, Cetomacrogol 1000, Cocamide DEA, Cocamide MEA, Decyl glucoside, Glyceryl laurate, Isoceteth-20, Lauryl glucoside, narrow-range ethoxylates (NRE), Nonidet P-40, Nonoxynol-9, nonylphenol ethoxylates, NP 40 (Tergitol), Octaethylene glycol monododecyl ether (C12E8), Octyl glucoside, Octoxynol-9(Triton X-100), Octoxynol, Pentaethylene glycol monododecyl ether (C12E5), Poloxamer, Polysorbate, Polysorbate 20(Tween 20), Polysorbate 80(Tween 80), Sorbitan monostearate (Span 60), and Sorbitan tristearate (Span 65).

A preferred nonionic surfactant is octoxynol, specifically octoxynol-9 (Triton X-100).

Inorganic Salt

The next sets of examples contain an inorganic salt, in which a portion remains in crystalline form. The salt in crystalline form can be used an abrasive to speed up the cleaning process.

Example #11

| Component | wt. % |
|---|---|
| Acetone | 61 |
| Water | 19.05 |
| Salt | 19.95 |
| Total | 100% |

Example 11 was prepared by combining water with an inorganic salt. Then, acetone was added and it was mixed completely. The composition remained stable. The composition was then shaken again and poured into a vessel containing a large amount of organic deposits disposed on the interior surface. It was then shaken vigorously for up to 300 seconds, or 5 minutes, or until clean. Results were noticeable immediately. All organic deposits from the interior were successfully removed without damage to the substrate.

A Preferred Embodiment of Example 11

This example contains following components:

| Component | wt. % |
|---|---|
| Acetone | 61 |
| Water | 19.05 |
| NaCl | 19.95 |
| Total | 100% |

Example #12

| Component | wt. % |
|---|---|
| Acetone | 75 |
| Water | 20 |
| Salt | 5 |
| Total | 100% |

Example 12 was prepared by combining water with inorganic salt. Then, acetone was added and it was mixed completely. The composition remained stable. The composition was then shaken again and poured into a substrate containing a large amount of organic deposits disposed on the interior surface. It was then shaken vigorously for up to 300 seconds, or 5 minutes, or until clean. Results were noticeable immediately. All organic deposits from the interior were successfully removed without damage to the substrate.

Example #13

| Component | wt. % |
|---|---|
| Acetone | 75 |
| Water | 5.05 |
| Salt | 19.95 |
| Total | 100% |

Example 13 was prepared by combining water with inorganic salt. Then, acetone was added and it was mixed completely. The composition remained stable. The composition was then shaken again and poured into a vessel containing a large amount of organic deposits disposed on the interior surface. It was then shaken vigorously for up to 300 seconds, or 5 minutes, or until clean. Results were noticeable immediately. All organic deposits from the interior were successfully removed without damage to the vessel.

Example #14

| Component | wt. % |
|---|---|
| Acetone | 80 |
| Water | 0.05 |
| Salt | 19.95 |
| Total | 100% |

Example 15 was prepared by combining water with inorganic salt. Then, acetone was added and it was mixed completely. The composition remained stable. The composition was then shaken again and poured into a vessel containing a large amount of organic deposits disposed on the interior surface. It was then shaken vigorously for up to 300 seconds, or 5 minutes, or until clean. Results were noticeable immediately. All organic deposits from the interior were successfully removed without damage to the vessel.

Example #15

| Component | wt. % |
|---|---|
| Acetone | 90 |
| Water | 0.05 |
| Salt | 9.95 |
| Total | 100% |

Example 15 was prepared by combining water with inorganic salt. Then, acetone was added and it was mixed completely. The composition remained stable. The composition was then shaken again and poured into a vessel containing a large amount of organic deposits disposed on the interior surface. It was then shaken vigorously for up to 300 seconds, or 5 minutes, or until clean. Results were noticeable immediately. All organic deposits from the interior were successfully removed without damage to the vessel.

Example #16

| Component | wt. % |
|---|---|
| Acetone | 95 |
| Water | 0.05 |
| Salt | 4.95 |
| Total | 100% |

Example 16 was prepared by combining water with inorganic salt. Then, acetone was added and it was mixed completely. The composition remained stable. The composition was then shaken again and poured into a vessel containing a large amount of organic deposits disposed on the interior surface. It was then shaken vigorously for up to 300 seconds, or 5 minutes, or until clean. Results were noticeable immediately. All organic deposits from the interior were successfully removed without damage to the substrate.

Inorganic Salts include, but are not limited to:

The following is a list of acceptable salts:

| | | | |
|---|---|---|---|
| Sodium Chloride | NaCl | mwt. 58.4428 | sp. gr. 2.165 |
| Sodium Bromide | NaBr | mwt. 102.90 | sp. gr. 3.203 |
| Magnesium Bromide | MgBr | mwt. 184.13 | sp. gr. 3.72 |
| Magnesium Chloride | MgCl | mwt. 95.22 | sp. gr. 2.316 |
| Potassium Chloride | KCL | mwt. 74.54 | sp. gr. 1.984 |
| Potassium Bromide | KBr | mwt. 119.01 | sp. gr. 2.75 |
| Zinc Chloride | ZnCl | mwt. 136.30 | sp. gr. 2.91 |

A preferred salt is Sodium Chloride, NaCl.

Methyl Soyate

The following examples contain methyl soyate, or soy solvent. Soy solvent is a man made solvent made from soybean oil. Soybean oil is extracted from soybeans using hexane and then processed with methanol to create methyl soyate, or soy solvent. It has been discovered that by combining ketone with methyl soyate a new cleaning composition for removing organic residues is created.

Example #17

| Component | wt. % |
|---|---|
| Acetone | 99.95 |
| Methyl Soyate | 0.05 |
| Total | 100% |

Example 17 was prepared by combining acetone with methyl soyate. The composition remained stable. The composition was then shaken again and poured into a vessel containing a large amount of organic deposits. It was then shaken vigorously for up to 300 seconds, or 5 minutes, or until clean. Results were noticeable immediately. All organic deposits from the interior were successfully removed without damage to the vessel.

Example #18

This example contains following components:

| Component | wt. % |
|---|---|
| Acetone | 50 |
| Methyl Soyate | 50 |
| Total | 100% |

Example 18 was prepared by combining acetone with methyl soyate. The composition remained stable. The composition was then shaken again and poured into a vessel containing a large amount of organic deposits. It was then shaken vigorously for up to 300 seconds, or 5 minutes, or until clean. Results were noticeable immediately. All organic deposits from the interior were successfully removed without damage to the vessel.

Example #19

| Component | wt. % |
|---|---|
| Acetone | 0.05 |
| Methyl Soyate | 99.95 |
| Total | 100% |

Example 19 was prepared by combining acetone with methyl soyate. The composition remained stable. The composition was then shaken again and poured into a vessel containing a large amount of organic deposits. It was then shaken vigorously for up to 300 seconds, or 5 minutes, or until clean. Results were noticeable immediately. All organic deposits from the interior were successfully removed without damage to the vessel.

Additional Examples

Example #20

| Component | wt. % |
|---|---|
| Acetone | 72 |
| Water | 11 |
| Nonionic Surfactant | 17 |
| Total | 100% |

Example 20 was prepared by combining water with nonionic Surfactant. Then, acetone was added and it was mixed completely. The composition remained stable. The composition was then shaken again and poured into a vessel containing a large amount of organic deposits disposed on the interior. It was then shaken vigorously up to 30 seconds. Results were noticeable immediately. All organic deposits from the interior were successfully removed without damage to the vessel.

Example #21

| Component | wt. % |
|---|---|
| Acetone | 35 |
| Water | 40 |
| Nonionic Surfactant | 25 |
| Total | 100% |

Example 21 was prepared by combining water with nonionic Surfactant. Then, acetone was added and it was mixed completely. The composition remained stable. The composition was then shaken again and poured into a vessel containing a large amount of organic deposits disposed on the interior. It was then shaken vigorously up to 30 seconds. Results were noticeable immediately. All organic deposits from the interior were successfully removed without damage to the vessel.

A fragrance and a dye may be added to the current invention and all claims and examples listed above.

Example 22

This example contains following components:

| Component | wt. % |
|---|---|
| Acetone | 15 |
| Methyl Soyate | 85 |
| Total | 100% |

Example 23

| Component | wt. % |
|---|---|
| Acetone | 72 |
| Octoxynol | 17 |
| Total | 100% |

Example 24

This example contains following components:

| Component | wt. % |
|---|---|
| Acetone | 35 |
| Water | 40 |
| Octoxynol | 25 |
| Total | 100% |

This was prepared by first combining water with Octoxynol. Then, acetone was added and it was mixed completely. The composition remained stable. The composition was then shaken again and poured into a vessel containing a large amount of organic deposits disposed thereon. It was then shaken vigorously up to 30 seconds. Results were noticeable immediately. All organic deposits from the interior were successfully removed without damage to the vessel.

Method of Use

Substrates in which composition was tested on:

1. A smokers pipe, large and small
2. A stained wine glass, in which a full glass of wine was allowed to evaporate, and
3. A Round bottom flask w/burnt resins stuck to the interior.

The composition was then shaken again and poured into a large smoker's pipe containing a large amount of organic deposits. It was then shaken vigorously for approximately 10-30 seconds. Results were noticeable immediately. All organic deposits from the interior were successfully removed without damage to the substrate.

The composition was again tested on a much smaller smoker's pipe. Due to size, the substrate was placed into a resealable plastic bag. This substrate also contained organic deposits on the exterior, as well as the interior. The substrate was then shaken vigorously in the resealable plastic bag for approximately 10-30 seconds. Results were noticeable immediately. All organic deposits from the interior, as well as the exterior, were successfully removed without damage to the substrate.

The composition was then shaken again and poured into a stained wine glass, in which a full glass of wine was allowed to evaporate. It was then rotated vigorously, clockwise or counter-clockwise, for approximately 10-30 seconds. Results were noticeable immediately. All wine stains from the interior were successfully removed without damage to the substrate.

The composition was then shaken again and poured into a round bottom flask with burnt resins stuck to the interior. It was then shaken vigorously for approximately 10-30 seconds. Results were noticeable immediately. All organic deposits from the interior were successfully removed without damage to the substrate.

Additional methods of the present invention include the following:

A method of cleaning a smokers pipe comprising the steps of:

a. providing a composition comprising a ketone, water, and an ionic surfactant, where the ratio of ketone:ionic surfactant does not exceed a 1:1 ratio, to a smokers pipe having a surface with organic residues to be removed;
b. agitating the composition for up to 300 seconds, or 5 minutes, or until clean;
c. removing the agitated composition; and
d. rinsing the surface of said smoker's pipe in which with water.

A method of cleaning a smokers pipe comprising the steps of:

a. providing a composition comprising a ketone, water, and an nonionic surfactant, where the ratio of ketone: nonionic surfactant does not exceed a 1:1 ratio, to a smokers pipe having a surface with organic residues to be removed;
b. agitating the composition from 31 seconds to up to 300 seconds, or 5 minutes, or until clean;
c. removing the agitated composition; and
d. rinsing the surface with water.

A method of cleaning a smokers pipe comprising the steps of:

a. providing a composition comprising a ketone in amount of 81-99 percent, Water in amount of 0.5 to 19 percent, and an nonionic surfactant in amount of 0.5 to 19 percent, to a smokers pipe having a surface with organic residues to be removed;

b. agitating the composition for up to 30 seconds or until clean;

c. removing the agitated composition; and d. rinsing the surface with water.

A method of cleaning a smokers pipe comprising the steps of:

a. providing a composition comprising a ketone, water, and an inorganic salt, whereas a portion of the inorganic salt remains in crystalline form, to a smokers pipe having a surface with organic residues to be removed;

b. agitating the composition for up to 300 seconds, or 5 minutes, or until clean;

c. removing the agitated composition; and d. rinsing the surface with water.

A method of cleaning a smokers pipe comprising the steps of:

a. providing a composition comprising a ketone and methyl soyate to a smokers pipe having a surface with organic residues to be removed;

b. agitating the composition for up to 300 seconds, or 5 minutes, or until clean;

c. removing the agitated composition; and d. rinsing the surface with water

A method of cleaning a smokers pipe comprising the steps of:

a. providing a composition comprising a ketone in amount of 11-72 percent, water in amount of 17 to 40 percent, and an nonionic surfactant in amount of 11 to 25 percent, to a smokers pipe having a surface with organic residues to be removed;

b. agitating the composition for up to 30 seconds or until clean;

c. removing the agitated composition; and d. rinsing the surface with water.

As used herein, the surface having organic residue disposed thereon is a surface of a smoker's pipe with residue in the interior, exterior, or combinations thereof.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

I claim:

1. A method of cleaning a smokers pipe comprising the steps of: a. providing a composition comprising at least 59% of a ketone, water, at least one salt selected from the group consisting of sodium chloride, sodium bromide, magnesium bromide, magnesium chloride, potassium chloride, potassium bromide, zinc chloride, whereas a portion of the salt remains in crystalline form, and an ionic surfactant to a smokers pipe having a surface with organic residues to be removed; b. agitating the composition for up to 300 seconds; c. removing the agitated composition; and d. rinsing the surface with water.

2. A method of cleaning a smokers pipe comprising the steps of: a. providing a composition comprising 59% of a ketone, water, at least one salt selected from the group consisting of sodium chloride, sodium bromide, magnesium bromide, magnesium chloride, potassium chloride, potassium bromide, zinc chloride, whereas a portion of the salt remains in crystalline form, and a nonionic surfactant to a smokers pipe having a surface with organic residues to be removed; b. agitating the composition from 31 seconds to up to 300 seconds; c. removing the agitated composition; and d. rinsing the surface with water.

3. A method of cleaning a smokers pipe comprising the steps of: a. providing a composition comprising a ketone in amount of 81-99 percent, water in amount of 0.5 to 19 percent, and a nonionic surfactant in amount of 0.5 to 19 percent, optionally at least one salt selected from the group consisting of sodium chloride, sodium bromide, magnesium bromide, magnesium chloride, potassium chloride, potassium bromide, zinc chloride, whereas a portion of the salt remains in crystalline form, to a smokers pipe having a surface with organic residues to be removed; b. agitating the composition for up to 30 seconds; c. removing the agitated composition; and d. rinsing the surface with water.

4. A method of cleaning a smokers pipe comprising the steps of: a. providing a composition comprising at least 59% of a ketone, Water, and an inorganic salt, whereas a portion of the inorganic salt remains in crystalline form, to a smokers pipe having a surface with organic residues to be removed; b. agitating the composition for up to 300 seconds; c. removing the agitated composition; and d. rinsing the surface with water.

5. A method of cleaning a smokers pipe comprising the steps of: a. providing a composition consisting essentially of at least 59% of a ketone and methyl soyate to a smokers pipe having a surface with organic residues to be removed; b. agitating the composition for up to 300 seconds; c. removing the agitated composition; and d. rinsing the surface with water.

6. A method of cleaning a smokers pipe comprising the steps of: a. providing a composition comprising a ketone in amount of 59-72 percent, water in amount of 17 to 40 percent, at least one salt selected from the group consisting of sodium chloride, sodium bromide, magnesium bromide, magnesium chloride, potassium chloride, potassium bromide, zinc chloride, whereas a portion of the salt remains in crystalline form, and a nonionic surfactant in amount of 11 to 25 percent, to a smokers pipe having a surface with organic residues to be removed; b. agitating the composition for up to 30 seconds; c. removing the agitated composition; and d. rinsing the surface with water.

* * * * *